US007478536B2

(12) United States Patent
Bliault et al.

(10) Patent No.: US 7,478,536 B2
(45) Date of Patent: Jan. 20, 2009

(54) FLOATING HYDROCARBON TREATING PLANT

(75) Inventors: Alan Edgar John Bliault, Rijswijk (NL); James Milne Cusiter, London (GB); Andrew Neil Stephens, London (GB)

(73) Assignee: Shell Oil Company, Houston, TX (US)

( * ) Notice: Subject to any disclaimer, the term of this patent is extended or adjusted under 35 U.S.C. 154(b) by 407 days.

(21) Appl. No.: 10/498,339

(22) PCT Filed: Dec. 12, 2002

(86) PCT No.: PCT/EP02/14181

§ 371 (c)(1),
(2), (4) Date: Apr. 28, 2005

(87) PCT Pub. No.: WO03/051711

PCT Pub. Date: Jun. 26, 2003

(65) Prior Publication Data

US 2005/0172645 A1 Aug. 11, 2005

(30) Foreign Application Priority Data

Dec. 14, 2001 (EP) ..... 01310466

(51) Int. Cl.
*F17C 13/08* (2006.01)
*B65D 88/78* (2006.01)
*B63B 35/44* (2006.01)

(52) U.S. Cl. ..... 62/53.2; 114/256; 114/264

(58) Field of Classification Search ..... 62/53.2; 114/256, 74 A, 264
See application file for complete search history.

(56) References Cited

U.S. PATENT DOCUMENTS

| | | | | |
|---|---|---|---|---|
| 3,498,392 | A * | 3/1970 | Knorr | 175/5 |
| 3,766,583 | A * | 10/1973 | Phelps | 405/203 |
| 4,041,721 | A * | 8/1977 | Kniel | 62/53.2 |
| 4,666,340 | A * | 5/1987 | Cox | 405/204 |
| 5,125,769 | A * | 6/1992 | Lee et al. | 405/204 |
| 5,407,302 | A * | 4/1995 | Springett et al. | 405/196 |
| 6,318,931 | B1 * | 11/2001 | Khachaturian | 405/204 |
| 2003/0102166 | A1 * | 6/2003 | Jortveit | 175/162 |

FOREIGN PATENT DOCUMENTS

| | | |
|---|---|---|
| EP | 0505167 A2 | 9/1992 |
| GB | 2172247 A | 9/1986 |

OTHER PUBLICATIONS

International Search Report dated May 9, 2003.
Kinney, Carl D, et al. "Floating LNG plant will stress reliability and safety", World Oil, vol. 218, No. 7, Jul. 1997 pp. 81-85.

* cited by examiner

*Primary Examiner*—William C Doerrler

(57) ABSTRACT

A floating hydrocarbon treating plant containing a vessel having a hull and a deck and having tanks located below the deck for storing hydrocarbons, and a plant for treating hydrocarbons located at the deck of the vessel is provided. The plant for treating hydrocarbons includes spaced-apart modules, wherein each module has related plant equipment mounted on a module floor, and the modules rest on closed support girders that extend under the module in a direction perpendicular to the edge of the deck, and wherein the module floor is secured to one of the closed support girders.

20 Claims, 1 Drawing Sheet

FLOATING HYDROCARBON TREATING PLANT

The present invention relates to a floating plant for treating hydrocarbons. Such a floating plant comprises a vessel having a hull and a deck. The vessel comprises tanks for storing hydrocarbons that are located below the deck. The floating plant further includes a plant for treating hydrocarbons that is located at the deck of the vessel. The vessel is furthermore provided with means for receiving natural gas and with means for delivering treated natural gas.

The plant for treating hydrocarbons includes spaced-apart modules, which modules have their own pre-determined function within the treating process. Each module comprises plant equipment needed for the function of the module, and the plant equipment is mounted on a module floor. In the specification and in the claims, the expression related plant equipment is used to refer to the plant equipment that is related to the function of the module.

In particular the present invention relates to a floating plant for liquefying natural gas. An example of such a floating plant is discussed in the article 'Floating LNG plant will stress reliability and safety', C D Kinney, H R Schulz, W Spring, World Oil, July 1997, pages 81-85.

In the article the need for a proper layout of the modules that make up the plant is emphasized in order to provide explosion protection.

It is an object of the present invention to provide protection in case an explosive fluid, such as liquefied natural gas, leaks from a module.

To this end the floating hydrocarbon treating plant according to the present invention comprises a vessel having a hull and a deck and comprising tanks located below the deck for storing hydrocarbons, and a plant for treating hydrocarbons located at the deck of the vessel, wherein the plant for treating hydrocarbons includes spaced-apart modules, wherein each module comprises related plant equipment mounted on a module floor, wherein the modules rest on closed support girders that extend under the module in a direction perpendicular to the edge of the deck, and wherein the module floor is secured to one of the closed support girders.

The module floors are open, for example they are from open grating, optionally reinforced by floor stiffeners, and thus fluid that leaks from a module is collected on the deck below the module floor. In the event of an explosion of the fluid, the blast is directed by the closed support girders to the edge of the deck. The closed girders prevent the blast from spreading in a direction perpendicular to the girders.

The present invention further relates to a floating hydrocarbon treating plant comprising a vessel having a hull and a double deck and comprising tanks located below the deck for storing hydrocarbons, and a plant for treating hydrocarbons located at the deck of the vessel, wherein the plant for treating hydrocarbons includes spaced-apart modules.

Suitably, each module comprises related plant equipment mounted on a module floor, and the modules rest on at least two closed support girders that extend under the module in a direction perpendicular to the edge of the deck, and wherein the module floor is secured to one of the closed support girders.

The invention will now be described by way of example in more detail with reference to the accompanying drawings, wherein FIG. 1 shows schematically and not to scale part of a top view of the floating hydrocarbon treating plant according to the present invention;

Figure 1:
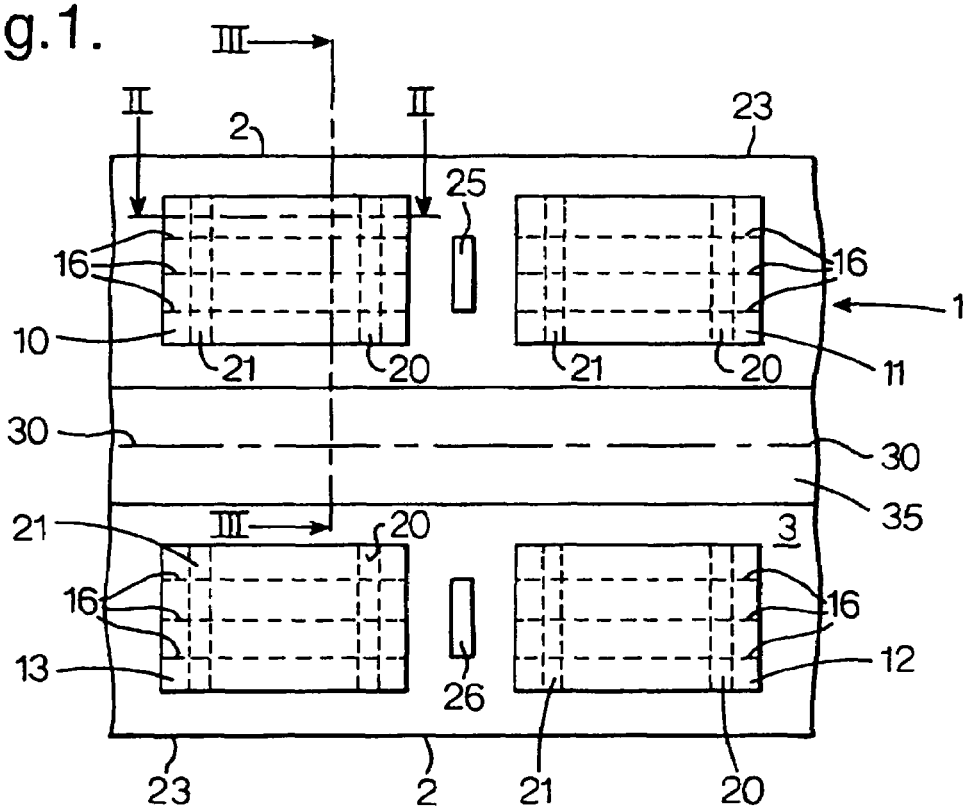

The floating hydrocarbon treating plant according to the present invention comprises a vessel 1 having a hull 2 and a deck 3. Inside the vessel 1, below the deck 3 tanks (not shown) are located in which hydrocarbons can be stored.

The deck 3 of the vessel 1 is provided with a plant for treating hydrocarbons. The plant for treating hydrocarbons includes several spaced-apart modules, of which four are shown in the Figures. The four modules are referred to with reference numerals 10, 11, 12 and 13. Each module 10, 11, 12 and 13 comprises a module floor 15 on which related plant equipment (not shown) of that module has been mounted. The module floor 15 is open so that fluids can pass through it. To reinforce the module floor 15, it includes floor stiffeners 16.

Each of the modules 10, 11, 12 and 13 is supported by two closed support girders, a fore closed support girder 20 and an aft closed support girder 21. The closed support girders 20 and 21 extend under the module 10, 11, 12 or 13 in a direction perpendicular to the edge 23 of the deck 3. Suitably the closed support girders 20 and 21 extend along at least 90% of the breadth of the module, and more suitably they extend along at least 95% of the breadth of the module.

In order to isolate the module 10, 11, 12 or 13 from longitudinal deflections of the vessel 1, the module floor 15 is secured to the fore closed support girder 20 only and it is laid on the aft closed support girder 21 so that the module floor 15 has a fixed end 15*a* and a free end 15*b*. If the friction between the module floor 15 and the aft closed support girder 21 on which it is laid is so large that the module floor 15 cannot slide over the aft girder 21, friction reducing means (not shown) can be applied between the module floor 15 and the girder 21 so as to form a free end bearing. It will be understood that the situation can be reversed: the module floor 15 is fixed to the aft girder 21 only and is laid on the fore girder 20.

In the event of an explosion of fluids that leaked through the module floor 15, the closed support girders 20 and 21 direct the blast to the edge 23 of the deck 3. The closed support girders 20 and 21 prevent the blast from spreading in a direction perpendicular to the girders to adjacent modules. Moreover tank manifolds, schematically shown as squares 25 and 26 are protected from the blast.

The displacements of the upper ends of the closed support girders 20 and 21 depend not only on the longitudinal deflections of the vessel 1, but also on the height of the girders 20 and 21, in other words, the lower the girders the smaller the displacements. The fact that the module floor is not fixed at both ends, but has a free end, allows selecting the height of the closed support girders so that they can contain the blast. In selecting the height, one does not need to consider the displacements of the upper ends of the closed support girders.

In order to contain the blast the closed support girders 20 and 21 is relatively high. Suitably the height of the closed girders 20 and 21 is more than 2 meters, and more suitable the height is between 3 and 5 meters. The number of closed support girders is suitably two per module, however, in some cases between three and five closed support girders per module is possible. In case there are more than two closed support girders per module, the module floor is secured to one of the closed support girders only and laid on the others.

To prevent rotation of a closed support girders about its longitudinal axis, the support girder can be provided with a set of triangular supports 28 secured to the deck 3. In addition to provide vertical stiffness, stiffeners (not shown) can be applied to the closed support girder at regular intervals along its length.

The modules have to be connected by pipes (not shown) in order that the hydrocarbon to be treated is conveyed from one unit to another.

Suitably the pipes (not shown) are arranged in a pipe-rack 35 that extends between opposite modules 10, 13 and 11, 12 along the centreline 30 of the vessel 1 so that the modules are arranged at either side of the pipe-rack 35. This arrangement of the pipe-rack 35 is particularly suitable if the vessel is an elongated vessel.

Figure 3:
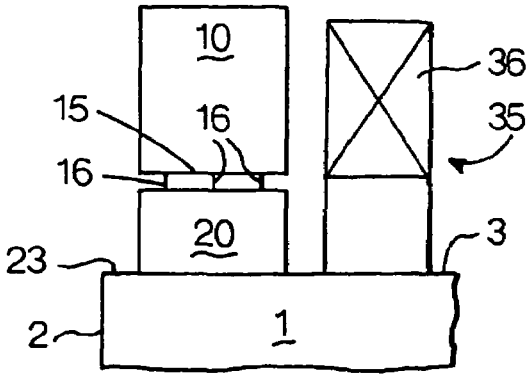
FIG. 3 is a partial sectional view along line III-III.

In order to increase the resistance to flow between opposite modules 10, 13 and 11, 12, the pipes are suitably arranged in the zone 36 (see FIG. 3) that is located above the level of the module floors 15. For access reasons, the pipes can be arranged about two to four meters above the level of the module floors 15.

The space under zone 36 can be used for other utilities, such as cables.

Figure 2:
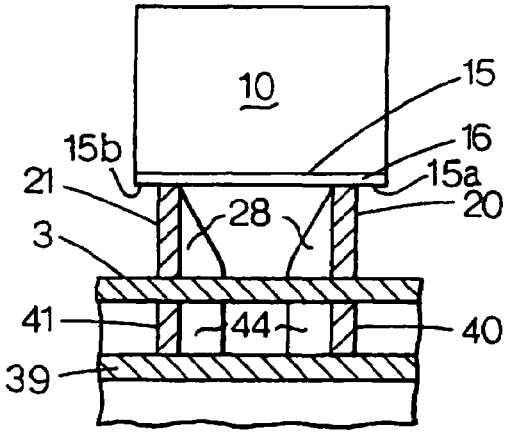
FIG. 2 is a partial sectional view along line II-II of FIG. 1.

In a suitable embodiment, the vessel 1 further comprises a lower deck 39 (see FIG. 2). In this case the deck 3 is called the upper deck. The upper deck 3 and the lower deck 39 form a double deck. Between the decks 3 and 39 transverse stiffeners 40 and 41 are placed, in such a way that each closed support girder 20, 21 is above a transverse stiffener 40, 41. In this way the two decks 3 and 39 carry the weight of the module.

In case the closed support girders 20 and 21 are provided with triangular supports 28 that are secured to the upper deck 3, the force exerted to the upper deck 3 can be transferred to the transverse stiffeners 40 and 41, or to the lower deck 39 or to both by suitable load transfer members 44.

The plant for treating hydrocarbons suitably comprises a plant for liquefying natural gas. Further the plant for treating hydrocarbons can comprise a plant for removing heavy hydrocarbons from natural gas or a plant for removing contaminants, such as acid gas, water or mercury, from the natural gas.

We claim:

1. A floating hydrocarbon treating plant comprising a vessel having a hull and a deck and comprising tanks located below the deck for storing hydrocarbons, and a plant for treating hydrocarbons located at the deck of the vessel, wherein the plant for treating hydrocarbons includes spaced-apart modules, wherein each module comprises related plant equipment mounted on a module floor, and the modules rest on at least two closed support girders that extend under the module in a direction perpendicular to the edge of the deck, and wherein the module floor is secured to only one of the closed support girders.

2. The floating hydrocarbon treating plant of claim 1 further comprising a pipe-rack supporting pipes that form the fluid connection between the equipment, which pipe-rack extends along the centreline of the vessel, wherein the modules are arranged at either side of the pipe-rack.

3. The floating hydrocarbon treating plant of claim 2 wherein the pipes are located above the level of the module floor.

4. The floating hydrocarbon treating plant of claim 1 wherein the deck is a double deck consisting of an upper deck and a lower deck.

5. The floating hydrocarbon treating plant of claim 1 wherein the plant for treating hydrocarbons comprises a plant for liquefying natural gas.

6. The floating hydrocarbon treating plant of claim 5 wherein the plant for treating hydrocarbons further comprises a plant for removing heavy hydrocarbons from natural gas.

7. The floating hydrocarbon treating plant of claim 2 wherein the deck is a double deck consisting of an upper deck and a lower deck.

8. The floating hydrocarbon treating plant of claim 3 wherein the deck is a double deck consisting of an upper deck and a lower deck.

9. The floating hydrocarbon treating plant of claim 2 wherein the plant for treating hydrocarbons comprises a plant for liquefying natural gas.

10. The floating hydrocarbon treating plant of claim 3 wherein the plant for treating hydrocarbons comprises a plant for liquefying natural gas.

11. The floating hydrocarbon treating plant of claim 4 wherein the plant for treating hydrocarbons comprises a plant for liquefying natural gas.

12. A floating hydrocarbon treating plant comprising a vessel having a hull and a deck and comprising tanks located below the deck for storing hydrocarbons, and a plant for treating hydrocarbons located at the deck of the vessel, wherein the plant for treating hydrocarbons includes spaced-apart modules, wherein each module comprises related plant equipment mounted on a module floor, and the modules rest on at least two closed support girders that extend under the module in a direction perpendicular to the edge of the deck, and wherein the module floor is secured to one of the closed support girders and further comprising a pipe-rack supporting pipes that form the fluid connection between the equipment, which pipe-rack extends along the centreline of the vessel, wherein the modules are arranged at either side of the pipe-rack.

13. The floating hydrocarbon treating plant of claim 12 wherein the pipes are located above the level of the module floor.

14. The floating hydrocarbon treating plant of claim 12 wherein the deck is a double deck consisting of an upper deck and a lower deck.

15. The floating hydrocarbon treating plant of claim 12 wherein the plant for treating hydrocarbons comprises a plant for liquefying natural gas.

16. The floating hydrocarbon treating plant of claim 15 wherein the plant for treating hydrocarbons further comprises a plant for removing heavy hydrocarbons from natural gas.

17. The floating hydrocarbon treating plant of claim 13 wherein the deck is a double deck consisting of an upper deck and a lower deck.

18. The floating hydrocarbon treating plant of claim 13 wherein the plant for treating hydrocarbons comprises a plant for liquefying natural gas.

19. The floating hydrocarbon treating plant of claim 14 wherein the plant for treating hydrocarbons comprises a plant for liquefying natural gas.

20. The floating hydrocarbon treating plant of claim 12 wherein the module floor is secured to only one of the closed support girders.

* * * * *